US011971223B2

(12) United States Patent
Ma et al.

(10) Patent No.: US 11,971,223 B2
(45) Date of Patent: Apr. 30, 2024

(54) MODULAR SQUARE-CIRCULAR COMPOSITE CHANNEL PRINTED CIRCUIT HEAT EXCHANGER

(71) Applicant: Xi'an Jiaotong University, Shaanxi (CN)

(72) Inventors: Ting Ma, Shaanxi (CN); Dongjun Xu, Shaanxi (CN); Zhendong Han, Shaanxi (CN); Qiuwang Wang, Shaanxi (CN)

(73) Assignee: XI'AN JIAOTONG UNIVERSITY, Shaanxi (CN)

( * ) Notice: Subject to any disclaimer, the term of this patent is extended or adjusted under 35 U.S.C. 154(b) by 0 days.

(21) Appl. No.: 18/515,979

(22) Filed: Nov. 21, 2023

(65) Prior Publication Data

US 2024/0085115 A1 Mar. 14, 2024

(30) Foreign Application Priority Data

Jan. 9, 2023 (CN) ..... 2023100233227

(51) Int. Cl.
*F28D 7/10* (2006.01)
*F28F 13/06* (2006.01)

(52) U.S. Cl.
CPC ..... *F28D 7/103* (2013.01); *F28F 13/06* (2013.01)

(58) Field of Classification Search
CPC ..... F28D 7/103; F28D 7/0008; F28D 7/02; F28F 13/06; F28F 3/086
See application file for complete search history.

(56) References Cited

U.S. PATENT DOCUMENTS

| | | | | |
|---|---|---|---|---|
| 10,107,555 | B1 * | 10/2018 | Miller | B23P 15/26 |
| 11,213,923 | B2 * | 1/2022 | Stewart, Jr. | B23P 15/26 |
| 11,754,341 | B2 * | 9/2023 | Horoszczak | F28F 1/006 165/110 |
| 11,802,742 | B2 * | 10/2023 | Fujiwara | F28F 7/02 |
| 2017/0081040 | A1 | 3/2017 | Pal | |
| 2019/0033013 | A1 * | 1/2019 | Byfield | F28D 9/0062 |
| 2019/0056147 | A1 | 2/2019 | Brisebois | |
| 2019/0383565 | A1 * | 12/2019 | Strömer | F28F 9/0265 |
| 2019/0390914 | A1 * | 12/2019 | St. Rock | F28F 7/02 |
| 2020/0318913 | A1 * | 10/2020 | Ruiz | F28D 7/0008 |
| 2022/0341431 | A1 | 10/2022 | Tivadar | |

* cited by examiner

*Primary Examiner* — Tho V Duong

(57) ABSTRACT

The present invention relates to the field of printed circuit heat exchangers, and in particular, to a modular square-circular composite channel printed circuit heat exchanger. The modular square-circular composite channel printed circuit heat exchanger comprises a shell, wherein the shell is divided into an inlet diverter section, a first parallel heat exchange section, a core heat exchange section, a second parallel heat exchange section, and an outlet combiner section from left to right, a plurality of square fin channels and circular micro-channels are uniformly arranged in the shell along a length direction of the shell. According to the present invention, a ratio of an average thermal resistance of a hot side to an average thermal resistance of a cold side is close to 1, which ensures the heat exchange efficiency while taking into the account structure safety and prevents the local over-temperature.

6 Claims, 8 Drawing Sheets

MODULAR SQUARE-CIRCULAR COMPOSITE CHANNEL PRINTED CIRCUIT HEAT EXCHANGER

TECHNICAL FIELD

The present invention relates to the field of printed circuit heat exchangers, and in particular, to a modular square-circular composite channel printed circuit heat exchanger.

BACKGROUND

As an important component in various industrial systems, the heat exchanger can effectively improve the compression efficiency of the equipment such as a compressor by cooling an incoming high-temperature working fluids and then conveying the working fluids to subsequent equipment such as a compressor and a pump, so that the cycle performance of the industrial system is further improved. To deploy a heat exchanger into space and weight restriction applications such as aerospace vehicles and new generation nuclear reactors, many industrial systems are developing towards miniaturized and lightweight distributed systems; therefore, how to enable the heat exchanger to work normally in a limited space and reduce the volume and mass of the heat exchanger as much as possible is crucial to the performance optimization of the whole system.

The commonly used heat exchanger mainly includes a shell-and-tube heat exchanger, a tube and fin heat exchanger, a plate heat exchanger, a mini-channel heat exchanger, and the like. Compared with a conventional heat exchanger, the printed circuit heat exchanger has the advantages of a more compact structure, higher heat transfer efficiency, far higher power density than other heat exchangers, and good applicability in an environment with high temperature, high pressure, and limited space.

Aiming at an extreme working condition that a working pressure ratio of a hot side to a cold side is less than or equal to 2%, a ratio of a mass flow of the hot side to a mass flow of the cold side is greater than or equal to 400%, and a ratio of a specific heat capacity of a hot side medium to a specific heat capacity of cold-side fluid is less than or equal to 500%, if a conventional symmetrical structure is uniformly arranged in a conventional printed circuit heat exchanger, the average thermal resistance of the hot side is far greater than that of the cold side, and a ratio of the average thermal resistance of the hot side to the average thermal resistance of the cold side is far greater than one, which causes design redundancy, insufficient heat exchange, and overlarge resistance; consequently, it is impossible to ensure the heat transfer efficiency while taking into account the structure safety.

SUMMARY

The present invention provides a modular square-circular composite channel printed circuit heat exchanger, so as to solve the foregoing problem.

In order to achieve the foregoing objective, the present invention adopts the following technical solutions:

A modular square-circular composite channel printed circuit heat exchanger comprises a shell, wherein the shell is divided into an inlet diverter section, a first parallel heat exchange section, a core heat exchange section, a second parallel heat exchange section, and an outlet combiner section from left to right, a plurality of square fin channels and circular mini-channels are uniformly arranged in the shell along a length direction of the shell, the plurality of square fin channels all penetrate through the first parallel heat exchange section, the core heat exchange section, and the second parallel heat exchange section sequentially, the plurality of circular mini-channels all penetrate through the shell, a periphery of each square fin channel in the core heat exchange section is provided with at least three circular mini-channels for exchanging heat with the square fin channel, and a ratio of a number of the square fin channels to a number of the circular mini-channels is greater than one.

Preferably, the inlet diverter section is hollow and has a front wall provided with a hot fluid inlet, and a hot fluid enters the inlet diverter section through the hot fluid inlet to exchange heat with the circular mini-channels of an inner cavity of the inlet diverter section, and then flows into the plurality of square fin channels.

Preferably, the plurality of circular mini-channels and square fin channels in the first parallel heat exchange section and the second parallel heat exchange section are horizontally and uniformly arranged and are sequentially and alternately arranged from top to bottom, so that a cold fluid in the circular mini-channels and a hot fluid in the square fin channels can be subjected to up-and-down parallel heat exchange.

Preferably, the plurality of square fin channels comprise straight square fin channels and bent square fin channels bent downwards at two ends of the core heat exchange section, the plurality of circular mini-channels comprise straight circular mini-channels and bent circular mini-channels bent downwards at two ends of the core heat exchange section, the straight square fin channels and the straight circular mini-channels are alternately arranged up and down in the heat exchanger core section to form a first core heat exchange group, the bent square fin channels and the bent circular mini-channels are alternately arranged up and down in the core heat exchange section to form a second core heat exchange group, the first core heat exchange group and the second core heat exchange group are alternately arranged back and forth in the heat exchanger core section to form a cross heat exchange group, a periphery of two rows of square fin channels that are of the cross heat exchange group and that are close to a front wall and a rear wall of the heat exchanger core section is provided with three circular mini-channels for exchanging heat with the square fin channels, and the other square fin channels of the cross heat exchange group are respectively provided with circular mini-channels at upper, lower, left and right sides for exchanging heat with the square fin channels, wherein a circle center connecting line of upper and lower circular mini-channels and a circle center connecting line of left and right circular mini-channels are vertically intersected to form a cross shape.

Preferably, the outlet combiner section is hollow and has a rear wall provided with a cold fluid outlet, and a hot fluid enters an inner cavity of the outlet combiner section through the square fin channel after exchanging heat and being cooled at the heat exchanger core section to exchange heat with the circular mini-channel of the inner cavity of the outlet combiner section, and then flows out of the fluid outlet.

Preferably, a surface that is of the circular mini-channel and that is located in the outlet combiner section is provided with a tube external fin to increase heat transfer area.

The beneficial effects of the present invention are as follows.

The present invention comprises a shell, wherein the shell is divided into an inlet diverter section, a first parallel heat exchange section, a heat exchanger core section, a second parallel heat exchange section, and an outlet combiner section from left to right, a plurality of square fin channels and circular mini-channels are uniformly arranged in the shell along a length direction of the shell, the plurality of square fin channels all penetrate through the first parallel heat exchange section, the heat exchanger core section, and the second parallel heat exchange section sequentially, the plurality of circular mini-channels all penetrate through the shell, a periphery of each square fin channel in the heat exchanger core section is provided with at least three circular mini-channels for exchanging heat with the square fin channel, and a ratio of a number of the square fin channels to a number of the circular mini-channels is greater than one. Since the hot-side pressure is extremely low and the hot-side mass flow rate is extremely high, a square fin channel is adopted, the compactness of a square fin channel is higher than that of a circular mini-channel when a hydraulic diameter is the same, and the average thermal resistance of the hot side can be greatly reduced; since the cold-side pressure is extremely high and the cold-side mass flow rate is extremely low, a circular mini-channel is adopted, a convective heat transfer coefficient is increased while the pressure is resisted, and the total heat resistance is reduced; in addition, since a ratio of a number of the square fin channels to a number of the circular mini-channels is greater than one, the number of the channels of the hot side is relatively large, and the heat transfer area of the hot side is larger than that of the cold side; although the convective heat transfer coefficient of the hot side is smaller than that of the cold side, the average thermal resistance of the hot side is quickly reduced through a relatively larger heat exchange area, and a ratio of the average thermal resistance of the hot side to the average thermal resistance of the cold side is close to one.

According to the present invention, the inlet diverter section belongs to a high temperature region, wherein the inlet diverter section is hollow and has a front wall provided with a hot fluid inlet, and a hot fluid enters the inlet diverter section through the hot fluid inlet to exchange heat with the circular mini-channels of an inner cavity of the inlet diverter section; no fins are added on an outer surface of the circular mini-channel of the inner cavity of the inlet diverter section to reduce the heat transfer area of the hot side and increase the streamwise thermal resistance gradient of the hot side; in addition, the circular mini-channel with a small hydraulic diameter is used in the cold side to enhance the heat exchange to increase the convective heat transfer coefficient, so that the local thermal resistance of the cold side is reduced, the thermal resistance ratio of the hot side to the cold side in the high temperature region is increased, and the total thermal resistance is reduced and a wall temperature of the high-temperature section is reduced, thereby ensuring the heat transfer efficiency while taking into account the structure safety.

According to the present invention, the first core heat exchange group and the second core heat exchange group in the heat exchanger core section are alternately arranged back and forth in the heat exchanger core section to form a cross heat exchange group, a periphery of two rows of square fin channels that are of the cross heat exchange group and that are close to a front wall and a rear wall of the heat exchanger core section is provided with three circular mini-channels for exchanging heat with the square fin channels, and the other square fin channels of the cross heat exchange group are respectively provided with circular mini-channels at upper, lower, left and right sides for exchanging heat with the square fin channels, wherein a circle center connecting line of upper and lower circular mini-channels and a circle center connecting line of left and right circular mini-channels are vertically intersected to form a cross shape; the arrangement of the central cross heat exchange structure with a square-circular composite channel is adopted, so that the hot fluid exchanges heat with the cold fluid uniformly distributed on the periphery; compared with the heat exchange channel with a conventional parallel arrangement structure, this arrangement not only implements heat exchange in a vertical direction between plate layers, but also increases the horizontal crosswise heat exchange, so that the heat transfer area is doubled, the thermal resistance of the cold side and the hot side as well as the total thermal resistance are reduced, and the heat transfer efficiency is greatly increased; meanwhile, the heat transfer structure can increase the uniformity of a flow field and a temperature field of a streamwise cross-section of a heat exchanger, and prevents local over-temperature.

According to the present invention, the outlet combiner section belongs to a middle-low temperature region, and a surface that is of the circular mini-channel and that is located in the outlet combiner section is provided with a tube external fin to increase the heat transfer area, so that the total thermal resistance and the thermal resistance ratio of the gas at the cold and hot sides of the middle-low temperature region are reduced, and this heat exchange structure is suitable for wide popularization.

Figure 1:
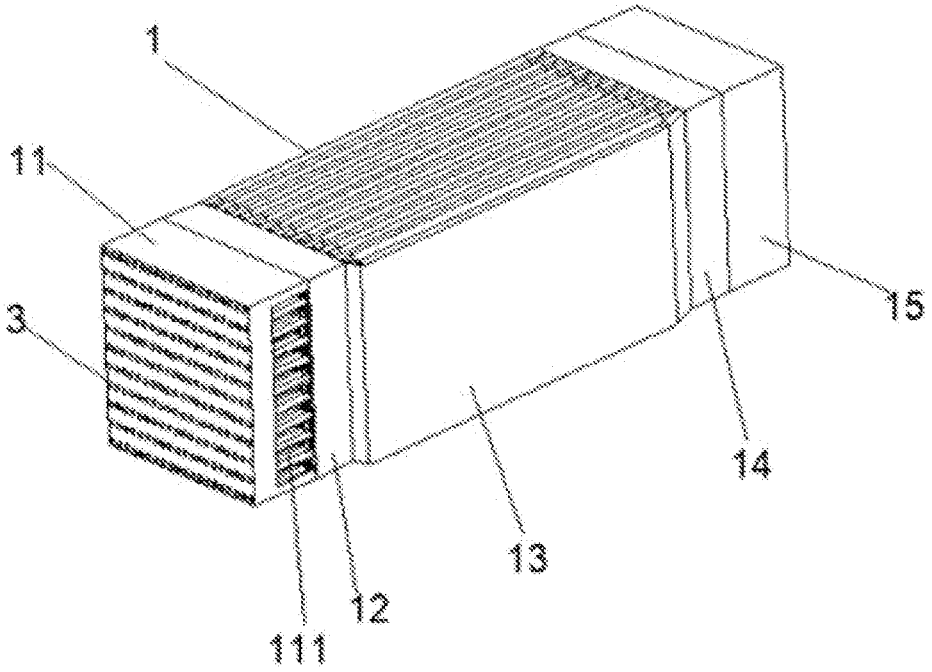
FIG. 1 is a schematic diagram of a structure of Embodiment 1 according to the present invention.
Figure 2:
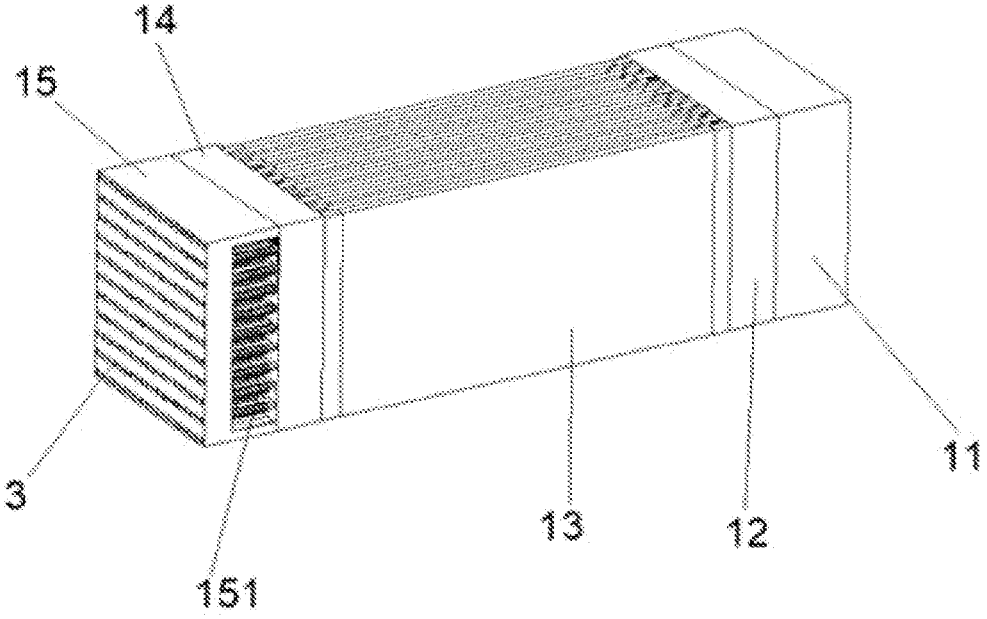
FIG. 2 is a schematic diagram of a structure of Embodiment 1 according to the present invention.
Figure 3:
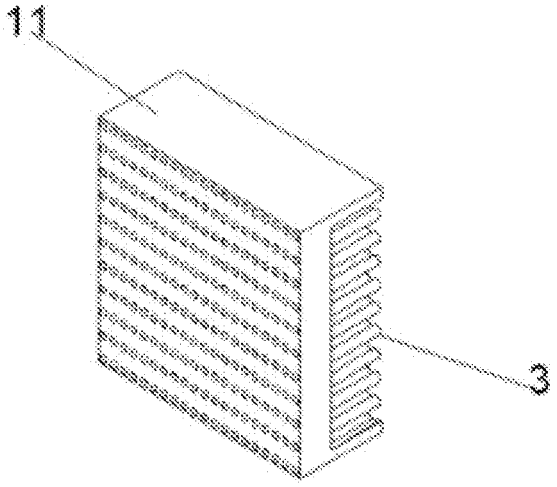
FIG. 3 is a schematic diagram of a structure of an inlet diverter section according to Embodiment 1 of the present invention.
Figure 4:
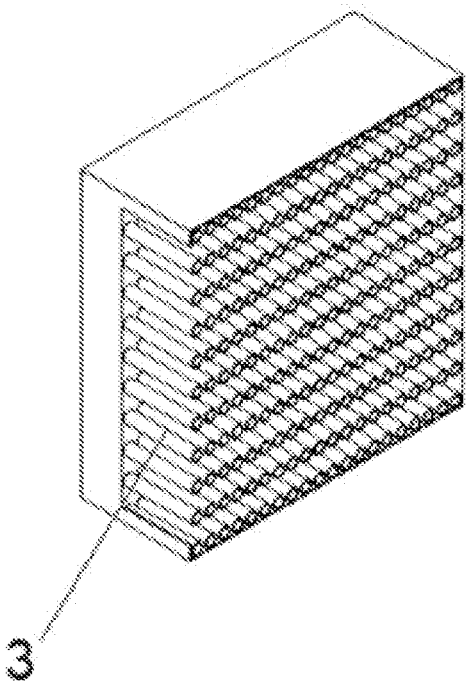
FIG. 4 is a schematic diagram of an internal structure of an inlet diverter section according to Embodiment 1 of the present invention.
Figure 5:
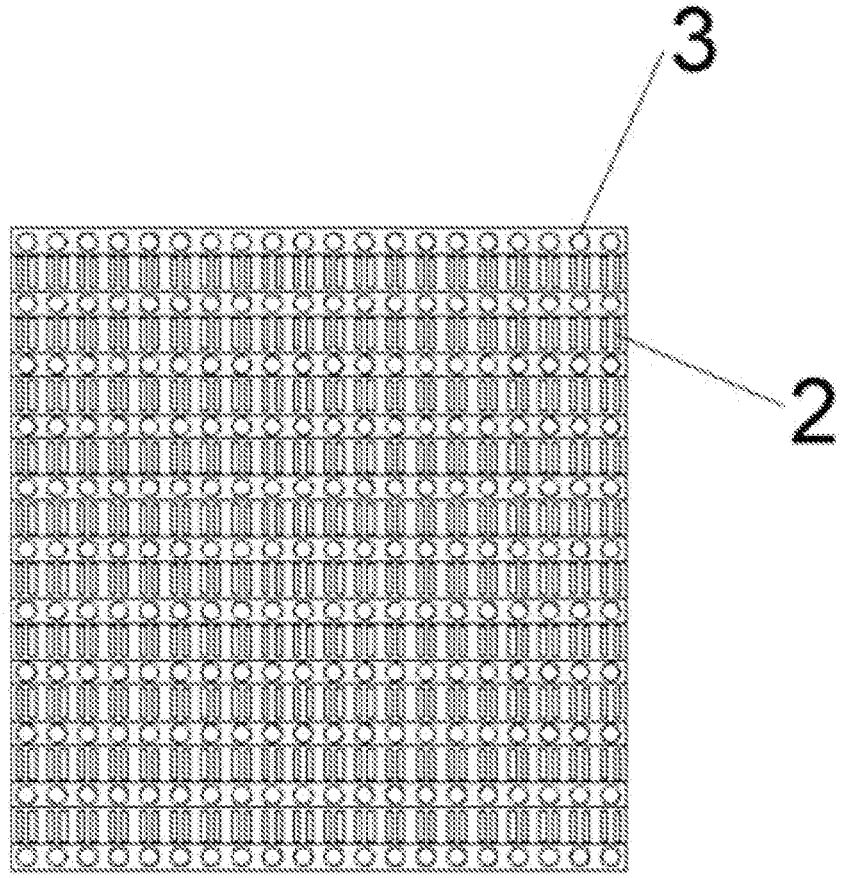
FIG. 5 is a schematic diagram of a cross-sectional structure of a first parallel heat exchange section according to Embodiment 1 of the present invention.
Figure 6:
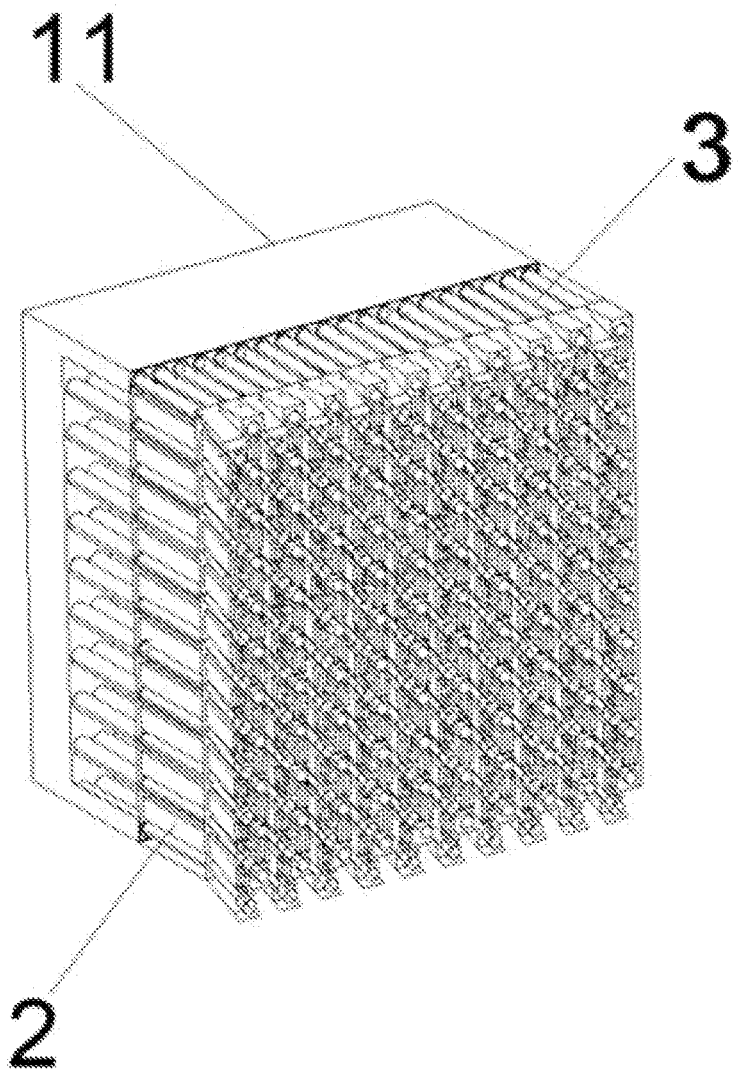
FIG. 6 is a schematic diagram of an internal structure of a first parallel heat exchange section according to Embodiment 1 of the present invention.
Figure 7:
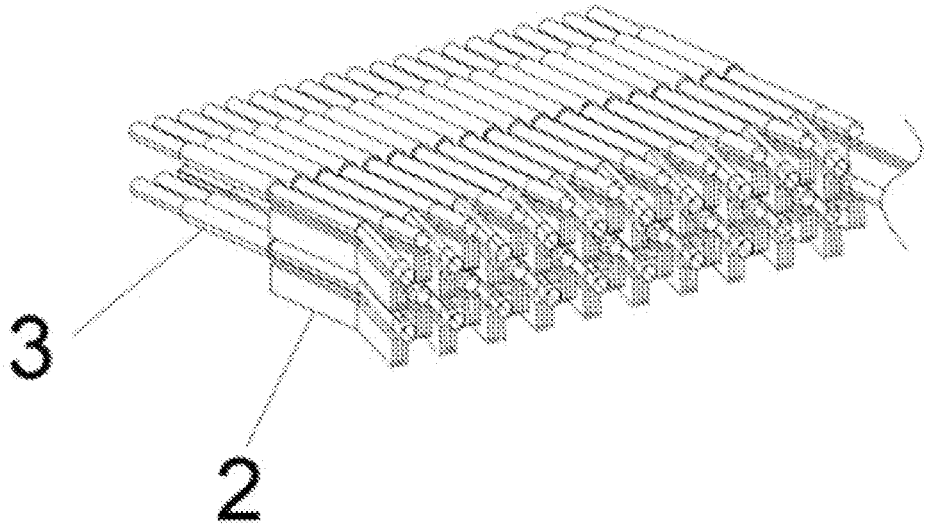
FIG. 7 is a schematic diagram of a structure of a cross heat exchange group according to Embodiment 1 of the present invention.
Figure 8:
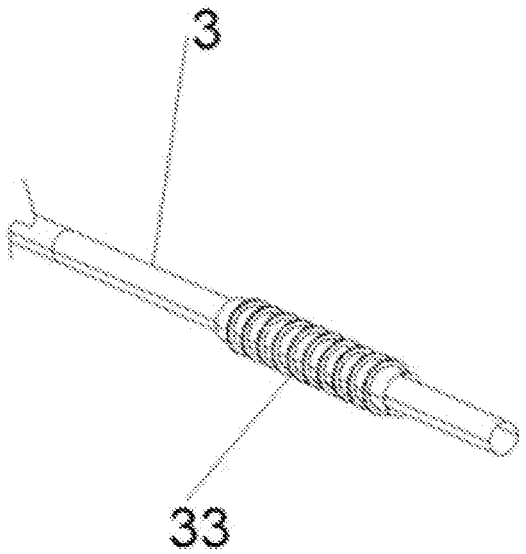
FIG. 8 is a schematic diagram of a structure of a tube external fin according to Embodiment 1 of the present invention.
Figure 9:
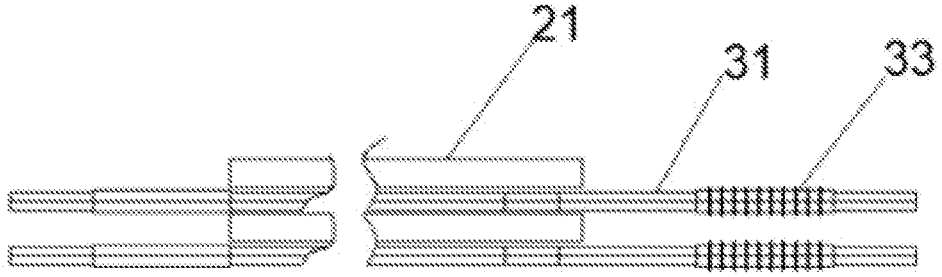
FIG. 9 is a schematic diagram of a structure of a first core heat exchange group according to Embodiment 1 of the present invention.
Figure 10:
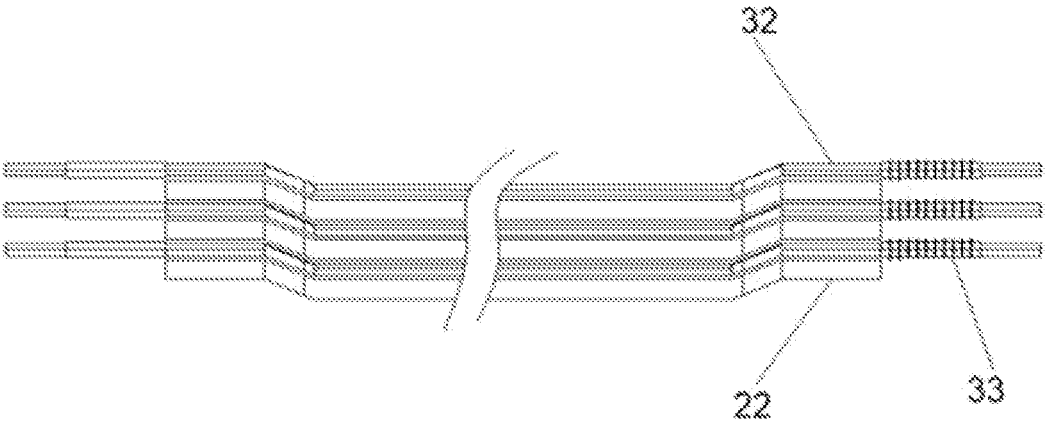
FIG. 10 is a schematic diagram of a structure of a second core heat exchange group according to Embodiment 1 of the present invention.

In the drawings, 1: shell, 11: inlet diverter section, 12: first parallel heat exchange section, 13: heat exchanger core section, 14: second parallel heat exchange section, 15: outlet combiner section, 2: square fin channel, 3: circular mini-channel, 111: hot fluid inlet, 21: straight square fin channel, 22: bent square fin channel, 31: straight circular mini-channel, 32: bent circular mini-channel, 33: tube external fin, 151: fluid outlet, 16: rectangular hot fluid inlet, 17: kidney-shaped channel, and 18: rectangular groove.

DETAILED DESCRIPTION OF EMBODIMENTS

The following clearly and completely describes the technical solutions in embodiments of the present invention with reference to the accompanying drawings in embodiments of the present invention. It is clear that the described embodiments are merely a part rather than all of embodiments of the present invention.

Embodiment 1

Referring to FIGS. 1 to 16, a modular square-circular composite channel printed circuit heat exchanger comprises: a shell 1, wherein the shell 1 is divided into an inlet diverter section 11, a first parallel heat exchange section 12, a heat exchanger core section 13, a second parallel heat exchange section 14, and an outlet combiner section 15 from left to right, a plurality of square fin channels 2 and circular mini-channels 3 are uniformly arranged in the shell 1 along a length direction of the shell, the plurality of square fin channels 2 all penetrate through the first parallel heat exchange section 12, the heat exchanger core section 13, and the second parallel heat exchange section 14 sequentially, the plurality of circular mini-channels 3 all penetrate through the shell 1, a periphery of each square fin channel 2 in the heat exchanger core section 13 is provided with at least three circular mini-channels 3 for exchanging heat with the square fin channel, and a ratio of a number of the square fin channels 2 to a number of the circular mini-channels 3 is greater than 1. The inlet diverter section 11 is hollow and has a front wall provided with a hot fluid inlet 111, and a hot fluid enters the inlet diverter section 11 through the hot fluid inlet 111 to exchange heat with the circular mini-channels 3 of an inner cavity of the inlet diverter section, and then flows into the plurality of square fin channels 2.

The plurality of circular mini-channels 3 and square fin channels 2 in the first parallel heat exchange section 12 and the second parallel heat exchange section 14 are horizontally and uniformly arranged and are sequentially and alternately arranged from top to bottom, so that a cold fluid in the circular mini-channels 3 and a hot fluid in the square fin channels 2 can be subjected to up-and-down parallel heat exchange.

The plurality of square fin channels 2 comprise straight square fin channels 21 and bent square fin channels 22 bent downwards at two ends of the heat exchanger core section 13, the plurality of circular mini-channels 3 comprise straight circular mini-channels 31 and bent circular mini-channels 32 bent downwards at two ends of the heat exchanger core section 13, the straight square fin channels 21 and the straight circular mini-channels 31 are alternately arranged up and down in the heat exchanger core section 13 to form a first core heat exchange group, the bent square fin channels 22 and the bent circular mini-channels 32 are alternately arranged up and down in the heat exchanger core section 13 to form a second core heat exchange group, the first core heat exchange group and the second core heat exchange group are alternately arranged back and forth in the heat exchanger core section 13 to form a cross heat exchange group, a periphery of two rows of square fin channels 2 that are of the cross heat exchange group and that are close to a front wall and a rear wall of the heat exchanger core section 13 is provided with three circular mini-channels 3 for exchanging heat with the square fin channels, and the other square fin channels 2 of the cross heat exchange group are respectively provided with circular mini-channels 3 at upper, lower, left and right sides for exchanging heat with the square fin channels, wherein a circle center connecting line of upper and lower circular mini-channels 3 and a circle center connecting line of left and right circular mini-channels 3 are vertically intersected to form a cross shape.

The outlet combiner section 15 is hollow and has a rear wall provided with a cold fluid outlet 151, and a hot fluid enters an inner cavity of the outlet combiner section 15 through the square fin channel 2 after exchanging heat and being cooled at the heat exchanger core section 13 to exchange heat with the circular mini-channel 3 of the inner cavity of the outlet combiner section, and then flows out of the fluid outlet 151. A surface that is of the circular mini-channel 3 and that is located in the outlet combiner section 15 is provided with a tube external fin 33 to increase the heat transfer area.

Working Principle:

A cold fluid for reducing the temperature flows in the circular mini-channel 3 and exchanges heat with a hot fluid in the square fin channel 2, and the hot fluid enters the inlet diverter section 11 through the hot fluid inlet 111 to exchange heat with the circular mini-channel 3 in an inner cavity of the inlet diverter section, then flows into the inner cavities of the plurality of square fin channels 2 in the first parallel heat exchange section 12 and performs parallel heat exchange with the circular mini-channel 3 in the first parallel heat exchange section 12; then the hot fluid enters the heat exchanger core section 13 through the square fin channel 2 and exchanges heat with the circular mini-channels 3 at a periphery of the square fin channel 2; next, the hot fluid enters the second parallel heat exchange section 14 and performs parallel heat exchange with the circular mini-channel 3 in the second parallel heat exchange section 14; and the hot fluid enters the outlet combiner section 15 and exchanges heat with the circular mini-channel 3 provided with the tube external fin 33 in the outlet combiner section 15 and then flows out of the fluid outlet 151 to complete the heat exchange.

Since the hot-side pressure is extremely low and the hot-side mass flow rate is extremely high, a square fin channel 2 is adopted, the compactness of a square fin channel 2 is higher than that of a circular channel when a hydraulic diameter is the same, and the average thermal resistance of the hot side can be greatly reduced; since the cold-side pressure is extremely high and the cold-side mass flow rate is extremely low, a circular mini-channel 3 is adopted, a convective heat transfer coefficient is increased while the pressure is resisted, and the total heat resistance is reduced; in addition, since a ratio of a number of the square fin channels 2 to a number of the circular mini-channels 3 is greater than one, the number of the channels of the hot side is relatively large, and the heat transfer area of the hot side is larger than that of the cold side; although a convective heat transfer coefficient of the hot side is smaller than that of the cold side, the average thermal resistance of the hot side is quickly reduced through relatively larger heat transfer area, and a ratio of the average thermal resistance of the hot side to the average thermal resistance of the cold side is close to one.

According to the present invention, the inlet diverter section 11 belongs to a high temperature region, wherein the inlet diverter section 11 is hollow and has a front wall provided with a hot fluid inlet 111, and a hot fluid enters the inlet diverter section 11 through the hot fluid inlet 111 to exchange heat with the circular mini-channels 3 of an inner cavity of the inlet diverter section; no fins are added on an outer surface of the circular mini-channel 3 of the inner cavity of the inlet diverter section 11 to reduce the heat transfer area of the hot side and increase the streamwise thermal resistance gradient of the hot side; in addition, the circular mini-channel with a small hydraulic diameter is used in the cold side to enhance the heat exchange to increase the convective heat transfer coefficient, so that the local thermal resistance of the cold side is reduced, the thermal resistance ratio of the hot side to the cold side in the high temperature region is increased, and the total thermal resistance is reduced and a wall temperature of the high-temperature section is reduced, thereby ensuring the heat transfer efficiency while taking into account the structure safety.

According to the present invention, the first core heat exchange group and the second core heat exchange group in the heat exchanger core section 13 are alternately arranged back and forth in the heat exchanger core section to form a cross heat exchange group, a periphery of two rows of square fin channels 2 that are of the cross heat exchange group and those are close to a front wall and a rear wall of the heat exchanger core section 13 is provided with three circular mini-channels 3 for exchanging heat with the square fin channels, and the other square fin channels 2 of the cross heat exchange group are respectively provided with circular mini-channels 3 at upper, lower, left and right sides for exchanging heat with the square fin channels, wherein a circle center connecting line of upper and lower circular mini-channels 3 and a circle center connecting line of left and right circular mini-channels 3 are vertically intersected to form a cross shape; the arrangement of the central cross heat exchange structure with a square-circular composite channel is adopted, so that the hot fluid exchanges heat with the cold fluid uniformly distributed on the periphery; compared with the heat exchange channel with a conventional parallel arrangement structure, this arrangement not only implements heat exchange in a vertical direction between plate layers, but also increases the horizontal crosswise heat exchange, so that the heat transfer area is doubled, the thermal resistance of the cold side and the hot side as well as the total thermal resistance are reduced, and the heat transfer efficiency is greatly increased; meanwhile, the heat transfer structure can increase the uniformity of a flow field and a temperature field of a streamwise cross-section of a heat exchanger, and prevents local over-temperature.

According to the present invention, the outlet combiner section 15 belongs to a middle-low temperature region, and a surface that is of the circular mini-channel 3 and that is located in the outlet combiner section 15 is provided with a tube external fin 33 to increase the heat transfer area, so that the total thermal resistance and the thermal resistance ratio of the gas at the cold and hot sides of the middle-low temperature region are reduced, and this heat exchange structure is suitable for wide popularization.

Embodiment 2

Figure 11:
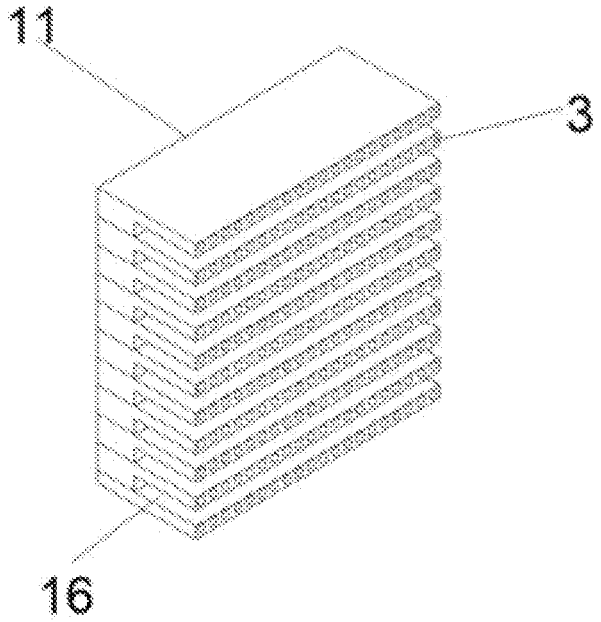
FIG. 11 is a schematic diagram of a structure of an inlet diverter section according to Embodiment 2 of the present invention.

As shown in FIG. 11, this embodiment differs from Embodiment 1 in that the inlet diverter section 11 is uniformly provided with 10 rectangular hot fluid inlets 16 from top to bottom, and the 10 rectangular hot fluid inlets 16 are respectively communicated with the square fin channels 2 in the first parallel heat exchange section 12.

Embodiment 3

Figure 12:
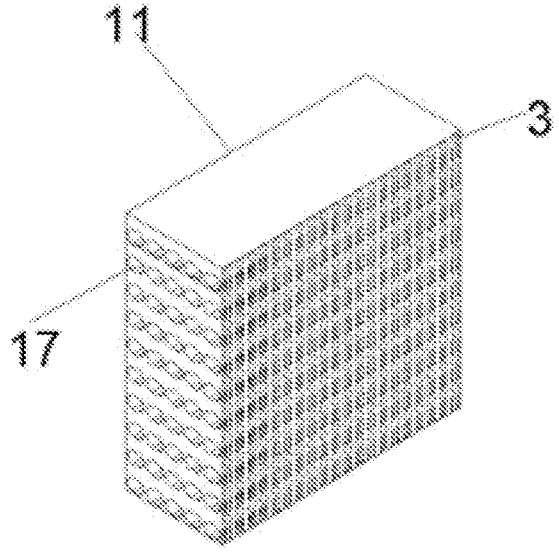
FIG. 12 is a schematic diagram of a structure of an inlet diverter section according to Embodiment 3 of the present invention.
Figure 13:
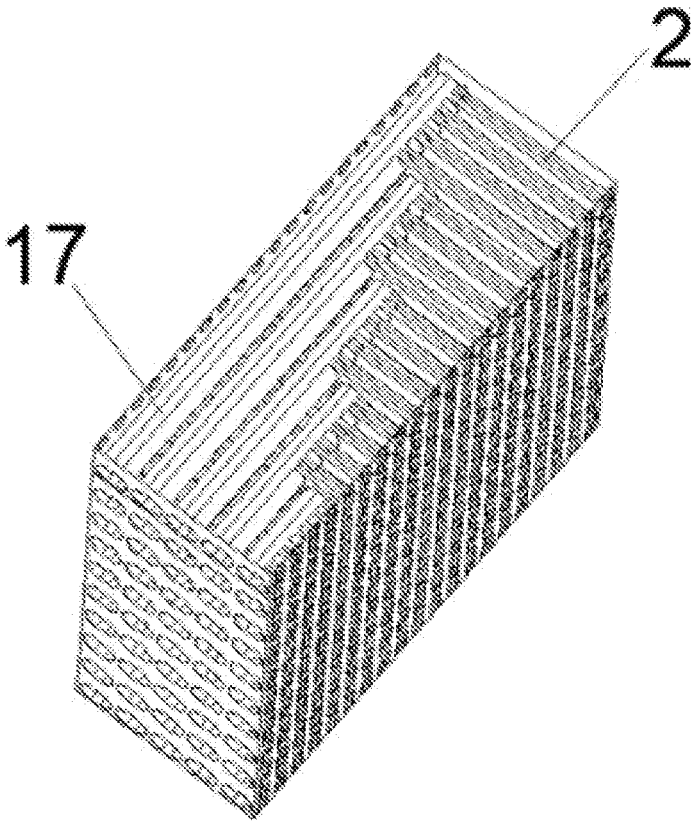
FIG. 13 is a schematic diagram of an internal structure of an inlet diverter section according to Embodiment 3 of the present invention.
Figure 14:
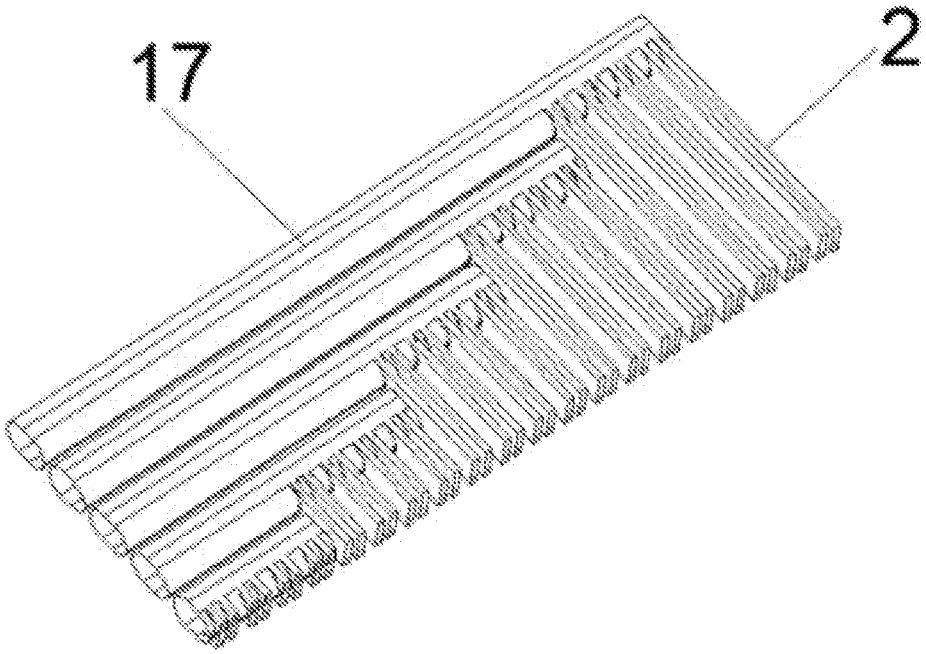
FIG. 14 is a schematic diagram of a structure of a kidney-shaped channel according to Embodiment 3 of the present invention.

As shown in FIGS. 12 to 14, this embodiment differs from Embodiment 1 in that the inlet diverter section 11 is uniformly provided with 10 layers of kidney-shaped channels 17 from top to bottom, and each layer is provided with 5 kidney-shaped channels 17 with different lengths that are respectively communicated with the square fin channels 2 with different lengths on the same layer, so that the hot fluid enters the square fin channels 2 through the kidney-shaped channels 17.

Embodiment 4

Figure 15:
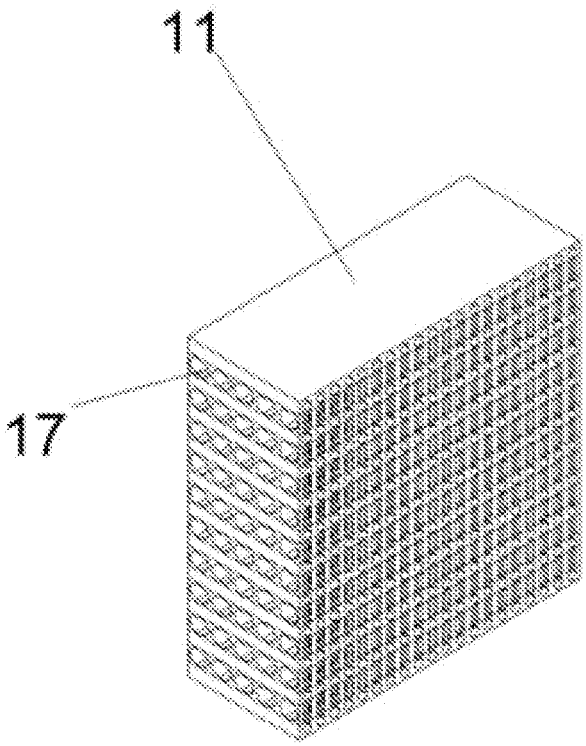
FIG. 15 is a schematic diagram of a structure of an inlet diverter section according to Embodiment 4 of the present invention.
Figure 16:
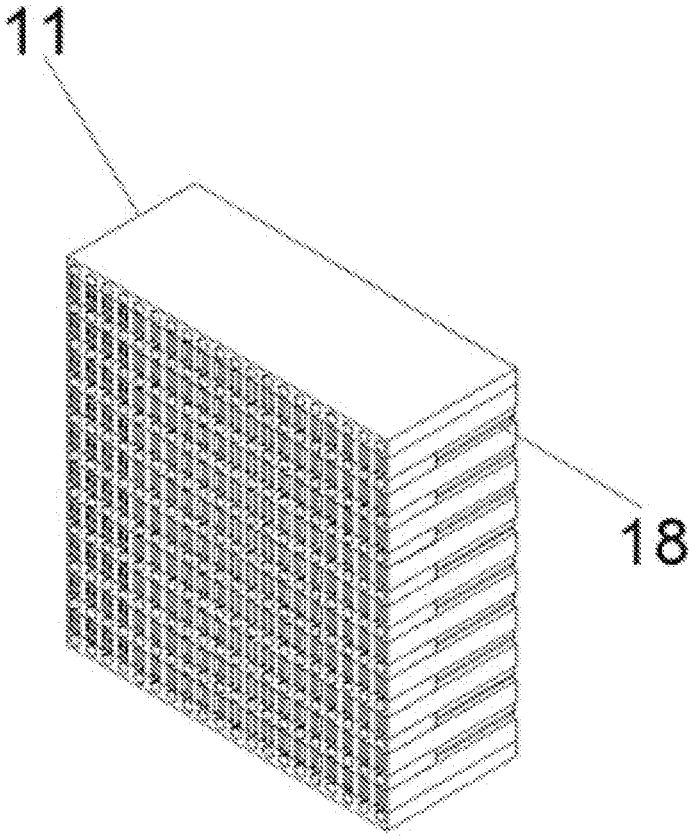
FIG. 16 is a schematic diagram of a structure of a rectangular groove according to Embodiment 4 of the present invention.

As shown in FIGS. 15 to 16, this embodiment differs from Embodiment 3 in that the inlet diverter section 11 is uniformly provided with 9 rectangular grooves 18 from top to bottom, and the circular mini-channels 3 penetrate through the 9 rectangular grooves 18.

The above description is merely a preferred specific implementation of the present invention, but is not intended to limit the protection scope of the present invention. Any equivalent replacements or changes made by any of those familiar with the technical field within the technical scope disclosed by the present invention according to the technical solutions and the inventive concepts of the present invention shall fall within the protection scope of the present invention.

What is claimed is:

1. A modular square-circular composite channel printed circuit heat exchanger, comprising: a shell, the shell being divided into an inlet diverter section, a first parallel heat exchange section, a heat exchanger core section, a second parallel heat exchange section, and an outlet combiner section from left to right, wherein a plurality of square fin channels and circular mini-channels are uniformly arranged in the shell along a length direction of the shell, the plurality of square fin channels all penetrate through the first parallel heat exchange section, the heat exchanger core section, and the second parallel heat exchange section sequentially, the plurality of circular mini-channels all penetrate through the shell, a periphery of each square fin channel in the heat exchanger core section is provided with at least three circular mini-channels for exchanging heat with the square fin channel, and a ratio of a number of the square fin channels to a number of the circular mini-channels is greater than one.

2. The modular square-circular composite channel printed circuit heat exchanger according to claim 1, wherein the inlet diverter section is hollow and has a front wall provided with a hot fluid inlet, and a hot fluid enters the inlet diverter section through the hot fluid inlet to exchange heat with the circular mini-channels of an inner cavity of the inlet diverter section, and then flows into the plurality of square fin channels.

3. The modular square-circular composite channel printed circuit heat exchanger according to claim 2, wherein the plurality of circular mini-channels and square fin channels in the first parallel heat exchange section and the second parallel heat exchange section are horizontally and uniformly arranged and are sequentially and alternately arranged from top to bottom, so that a cold fluid in the circular mini-channels and a hot fluid in the square fin channels can be subjected to up-and-down parallel heat exchange.

4. The modular square-circular composite channel printed circuit heat exchanger according to claim 3, wherein the plurality of square fin channels comprise straight square fin channels and bent square fin channels bent downwards at two ends of the heat exchanger core section, the plurality of circular mini-channels comprise straight circular mini-channels and bent circular mini-channels bent downwards at two ends of the heat exchanger core section, the straight square fin channels and the straight circular mini-channels are alternately arranged up and down in the heat exchanger core section to form a first core heat exchange group, the bent square fin channels and the bent circular mini-channels are alternately arranged up and down in the heat exchanger core section to form a second core heat exchange group, the first core heat exchange group and the second core heat exchange group are alternately arranged back and forth in the core heat exchange section to form a cross heat exchange group, a periphery of two rows of square fin channels that are of the cross heat exchange group and that are close to a front wall and a rear wall of the core heat exchange section is provided with three circular mini-channels for exchanging heat with the square fin channels, and the other square fin channels of the cross heat exchange group are respectively provided with circular mini-channels at upper, lower, left and right sides for exchanging heat with the square fin channels, wherein a circle center connecting line of upper and lower circular mini-channels and a circle center connecting line of left and right circular mini-channels are vertically intersected to form a cross shape.

5. The modular square-circular composite channel printed circuit heat exchanger according to claim 4, wherein the outlet combiner section is hollow and has a rear wall provided with a cold fluid outlet, and a hot fluid enters an inner cavity of the outlet combiner section through the square fin channel after exchanging heat and being cooled at the core heat exchange section to exchange heat with the circular mini-channel of the inner cavity of the outlet combiner section, and then flows out of the fluid outlet.

6. The modular square-circular composite channel printed circuit heat exchanger according to claim 5, wherein a surface that is of the circular mini-channel and that is located in the outlet combiner section is provided with a tube external fin to increase a heat transfer area.

* * * * *